United States Patent [19]

MacArthur et al.

[11] Patent Number: 4,842,719

[45] Date of Patent: Jun. 27, 1989

[54] CATALYTIC TWO-STAGE COAL HYDROGENATION AND HYDROCONVERSION PROCESS

[75] Inventors: James B. MacArthur, Denville; Joseph B. McLean, So. Somerville, both of N.J.; Alfred G. Comolli, Yardley, Pa.

[73] Assignee: HRI, Inc., Lawrenceville, N.J.

[21] Appl. No.: 876,307

[22] Filed: Jun. 18, 1986

Related U.S. Application Data

[63] Continuation of Ser. No. 725,458, Apr. 22, 1985, abandoned.

[51] Int. Cl.[4] ..... C10G 1/06; C10G 1/08

[52] U.S. Cl. ..... 208/421; 208/408; 208/422; 208/423; 208/428; 208/431; 208/409; 208/413

[58] Field of Search ..... 208/409, 413, 408, 421, 208/422, 423, 428, 437, 413

[56] References Cited

U.S. PATENT DOCUMENTS

| | | | |
|---|---|---|---|
| 3,540,995 | 11/1970 | Wolk et al. | 208/409 |
| 3,575,847 | 4/1971 | Sprow et al. | 208/10 |
| 3,594,305 | 7/1971 | Kirk, Jr. | 208/10 |
| 3,679,573 | 7/1972 | Johnson | 208/10 |
| 3,700,584 | 10/1972 | Johnson et al. | 208/10 |
| 4,054,504 | 10/1977 | Chervenak et al. | 208/10 |
| 4,111,787 | 9/1978 | Aldridge et al. | 208/413 |
| 4,210,518 | 7/1980 | Wilson et al. | 208/413 |
| 4,221,653 | 9/1980 | Chervenak et al. | 208/413 |
| 4,313,816 | 2/1982 | Veluswamy et al. | 208/10 |
| 4,316,792 | 2/1982 | Sze et al. | 208/408 |
| 4,316,793 | 2/1982 | Sze | 208/10 |
| 4,345,989 | 8/1982 | Vernon et al. | 208/413 |
| 4,376,695 | 3/1983 | Beunko et al. | 208/10 |
| 4,411,768 | 10/1983 | Unger et al. | 208/108 |
| 4,422,922 | 12/1983 | Rosenthal et al. | 208/10 |
| 4,431,510 | 2/1984 | Gatsis | 208/10 |
| 4,457,831 | 7/1984 | Gendler | 208/59 |
| 4,510,038 | 4/1985 | Kuehler | 208/10 |

FOREIGN PATENT DOCUMENTS

| | | | |
|---|---|---|---|
| 0017447 | 12/1928 | Australia | 208/413 |
| 3408095 | 9/1984 | Fed. Rep. of Germany | 208/413 |
| 2143843 | 2/1985 | United Kingdom | 208/413 |

*Primary Examiner*—Gary P. Straub

*Attorney, Agent, or Firm*—Fred A. Wilson

[57] ABSTRACT

A process for two-stage catalytic hydrogenation and liquefaction of coal to produce increased yields of low-boiling hydrocarbon liquid and gas products. In the process, the particulate coal is slurried with a process-derived liquid solvent and fed at temperature below about 650° F. into a first stage catalytic reaction zone operated at conditions which promote controlled rate liquefaction of the coal, while simultaneously hydrogenating the hydrocarbon recycle oils at conditions favoring hydrogenation reactions. The first stage reactor is maintained at 650°-800° F. temperature, 1000-4000 psig hydrogen partial pressure, and 10-60 lb coal/hr/ft$^3$ reactor space velocity. The partially hydrogenated material from the first stage reaction zone is passed directly to the close-coupled second stage catalytic reaction zone maintained at a temperature at least about 25° F. higher than for the first stage reactor and within a range of 750°-875° F. temperature for further hydrogenation and thermal hydroconversion reactions. By this process, the coal feed is successively catalytically hydrogenated and hydroconverted at selected conditions, which results in significantly increased yields of desirable low-boiling hydrocarbon liquid products and minimal production of undesirable residuum and unconverted coal and hydrocarbon gases, with use of less energy to obtain the low molecular weight products, while catalyst life is substantially increased.

11 Claims, 2 Drawing Sheets

CATALYTIC TWO-STAGE COAL HYDROGENATION AND HYDROCONVERSION PROCESS

The U.S. Government has rights to this invention pursuant to Contract No. DE-AC22-83PC0017 awarded by the U.S. Department of Energy.

This application is a continuation of application Ser. No. 725,458, filed Apr. 22, 1986 now abandoned.

BACKGOUND OF INVENTION

This invention pertains to an improved catalytic two-stage coal hyrogenation and hydroconversion process to produce increased yields of low-boiling hydrocarbon distillate liquid products. It pertains particularly to such a process in which the coal feed is rapidly heated and catalytically hydrogenated in a first reaction zone containing an ebullated catalyst bed, and then further hyrogenated and hydrocracked in a second close-coupled catalytic reaction zone at slightly higher temperature conditions to produce increased yields of desirable low boiling hydrocarbon liquid products while minimizing hydrocarbon catalyst gas yields and deactivation.

In the H-Coal® single stage coal liquefaction process, a particulate coal feed is usually slurried in a coal-derived recycle oil and the coal-oil slurry is preheated to a temperature near the reaction temperature then fed with hydrogen into a catalytic ebullated bed reactor, which operates at relatively high temperatures. In the reactor, a major portion of the coal is liquefied to produce hydrocarbon gas and distillate liquid fractions, but an undesirably large fraction of the coal liquefaction product is residual oil containing preasphaltenes and as asphaltene compounds. The preasphaltenes are highly unstable species at elevated temperatures, and can decompose thermally in the present of hydrogen to form asphaltenes while releasing gaseous hydrocarbons and water, but they can also rearrange, aromatize, and even condense to form char. In the reactor, the asphaltenes break down further heavy and light distillates, naptha and gaseous hydrocarbons.

In order to achieve satisfactory hydrocarbon liquid products in single-stage catalytic reaction processes, the reactor must be operated at a relatively high temperature which usually produces some retrograde materials and places a limit on the distillate liquid yields which can be achieved. Conventional single-stage catalytic processes for coal liquefaction and hydrogenation are generally disclosed in U.S. Pat. Nos. 3,519,555 and 3,791,959. In attempts to overcome the deficiencies of single-stage catalytic processes for coal liquefaction and hydrogenation, various two-stage catalytic processes have been proposed, including processes having thermal first stage reactor as well as catalytic-catalytic processes utilizing low first stage temperatures of only 600°-700° F. Examples of such coal hydrogenation processes using two stages of catalytic reaction are disclosed by U.S. Pat. Nos. 3,679,573; 3,700,584; 4,111,788; 4,350,582; 4,354,920; and 4,358,359.

Although these processes using two stages of coal hydrogenation have generally provided some improvements over a single stage coal liquefaction process, such processes usually produce low quality liquid solvent materials in the reactor and do not provide for the desired hydrogenation and high conversion of the coal feed to produce high yields of desirable low-boiling hydrocarbon liquid products with minimal yields of hydrocarbon gas and heavy residuum fractions. Such improved results have now been achieved by the present two-stage catalytic coal hydrogenation and hydroconversion process.

SUMMARY OF INVENTION

The invention provides an improved process for direct two-stage catalytic hydrogenation, liquefaction and hydroconversion of coal to produce significantly increased yields of desirable low-boiling hydrocarbon distillate liquid products with minimal yields of hydrocarbon gas and high-boiling resid fractions. In the process, a particulate coal such as bituminous, sub-bituminous or lignite and a process-derived recycled hydrocarbon liquid solvent material are mixed together, and the resulting flowable coal-oil slurry is hydrogenated and liquefied using two stage direct-coupled ebullated bed catalytic reactors connected in series.

The coal-oil slurry is fed into the first stage back-mixed catalytic reaction zone which is maintained at selected moderate temperature and pressure conditions and in the presence of a particulate hydrogenation catalyst which promotes controlled rate liquefaction of the coal, while simultaneously hydrogenating the recycle solvent oils, at conditions which favor hydrogenation reactions at temperatures less than about 800° F. The first stage reaction zone contains an ebullated bed of a particulate hydrogenation catalyst to hydrogenate the aromatic rings in the particulate coal, recycle solvent and dissolved coal molecules and produce the disired low-boiling hydrocarbon liquid and gaseous material.

The catalyst used in each stage reactor should be selected from the group consisting of oxides or other compounds of cobalt, iron, molybdenum, nickle, tin, tungsten and mixtures thereof and hydrocarbon hyrogenation catalyst metal oxides known in the art, deposited on a base or support material selected from the group consisting of alumina, magnesia, silica, titania, and similar materials. Useful catalyst particle sizes can range about 0.030 to 0.125 inch effective diameter.

The first stage reactor is maintained at conditions of 650°-800° F. temperature, 1000-4000 psig hydrogen partial pressure, and at 10-60 lb/coal hr/ft$^3$ reactor feed rate or space velocity to produce a high quality hydrocarbon solvent material, while achieving at least about 50 W % conversion of the coal tetrahydrofuran to (THF) soluble materials. At such mild reaction conditions, hydrocracking, condensation and polymerization reactions along with formation of hydrocarbon gases are all advantageously minimized. Preferred first-stage reaction conditions are 700°-790° F. temperature, 1500-3500 psig hydrogen partial pressure and a coal space velocity of 15-50 lbs coal/hr/ft$^3$ reactor, with the preferred conditions being specific to the type of coal being processed.

From the first stage reaction zone, the total effluent material containing hydrogen and heteratom gases, hydrocarbon gases, hydrocarbon liquid fractions and unconverted coal materials is passed with additional hydrogen directly to the second stage back mixed catalytic/reaction zone the material is further hydrogenated and hydrocracked at a temperature at least about 25° F. higher than for the first stage reaction zone. Both stage reaction zones are upflow, well mixed ebullated bed catalytic reactors. For the second stage reactor, operating conditions are maintained at higher severity conditions which promote more complete thermal conversion of the coal to liquids, hydroconversion of primary liquids to distillate products, and product quality improvement via heteroatoms removal at temperature greater than 800° F., and with similar hydrogen pressure and a hydroconversion catalyst such as cobalt-moly on alumina support material. The desired second stage reaction conditions are coal space velocity of 750°-875° F. temperature, 1000-4000 psig hydrogen partial pressure and 10-60 lb coal/hr/ft$^3$ reactor volume to achieve at least about 90 W % conversion of the remaining reactive coal along with the asphaltene and preasphaltene compounds, and the heteroatoms are further reduced to provide THF soluble products materials. Preferred second stage reaction conditions are 800°-860° F. temperature, 1500-3500 psig hydrogen partial pressure, and coal space velocity of 15-50 lb/hr ft$^3$ reactor volume.

This two-stage catalytic coal liquefaction process provides high selectivity to low-boiling hydrocarbon liquid products and desired low yields of $C_1$-$C_3$ hydrocarbon gases and residuum materials, together with minimal deactivation of the catalyst as measured by residuum conversion, where provides for extended activity and useful life of the catalyst. Overall, the present two-stage catalytic process produce higher yields of distillate and lower molecular weight products which are considerably more paraffinic and "petroleum-like" in terms of their chemical structure, than are produced by other single or two-stage direct coal liquefaction processes. It has been determined that the Watson characterization factor for the hydrocarbon liquid products in relation to their mean average boiling point from the present catalytic two-stage process are intermediate those products produced by the H-Coal® single-stage catalytic process and by petroleum catalytic hydroconversion processes.

The present two-stage direct coal liquefaction process advantageously provides a significant improvement over the single-stage H-Coal® coal liquefaction process, by providing an integrated recycle solvent hydrogenation step upstream of the conventional catalytic ebullated bed reactor. The reaction conditions are selected to provide controlled hydrogenation and conversion of the coal to liquid products (as defined by solubility in quinoline, tetrahydrofuran, or other similar solvent), while simultaneously hydrogenating the recycle and coal-derived product oils. Because the coal feed is dissolved in a high quality hydrocarbon solvent in the low temperature stage-stage reactor, the potential for retrogressive (coke forming) reactions is significantly reduced and solvent quality, hydrogen utilization and heteroatom removal are appreciably improved, which increases potential conversion of the coal while extending the catalyst life. The high quality effluent slurry material from the first stage reactor is fed to the close-coupled second stage catalytic reactor operated at somewhat higher temperatures to achieve increased coal conversion to mainly distillate liquid products.

The process thermal efficiency is advantageously improved over other two-stage coal liquefaction processes. Also, because of the high percentage conversion of coal to low-boiling hydrocarbon distillate liquids is achieved, higher boiling residuum fractions can be recycled to the first stage reactor. Thus, the present process advantageously achieves higher yields of distillate and lower molecular weight hydrocarbon products and less heteratoms with lower energy input than for single stage catalytic processes, and also for other thermal and thermal/catalytic two-stage coal liquefaction processes.

DESCRIPTION OF INVENTION

Figure 1:
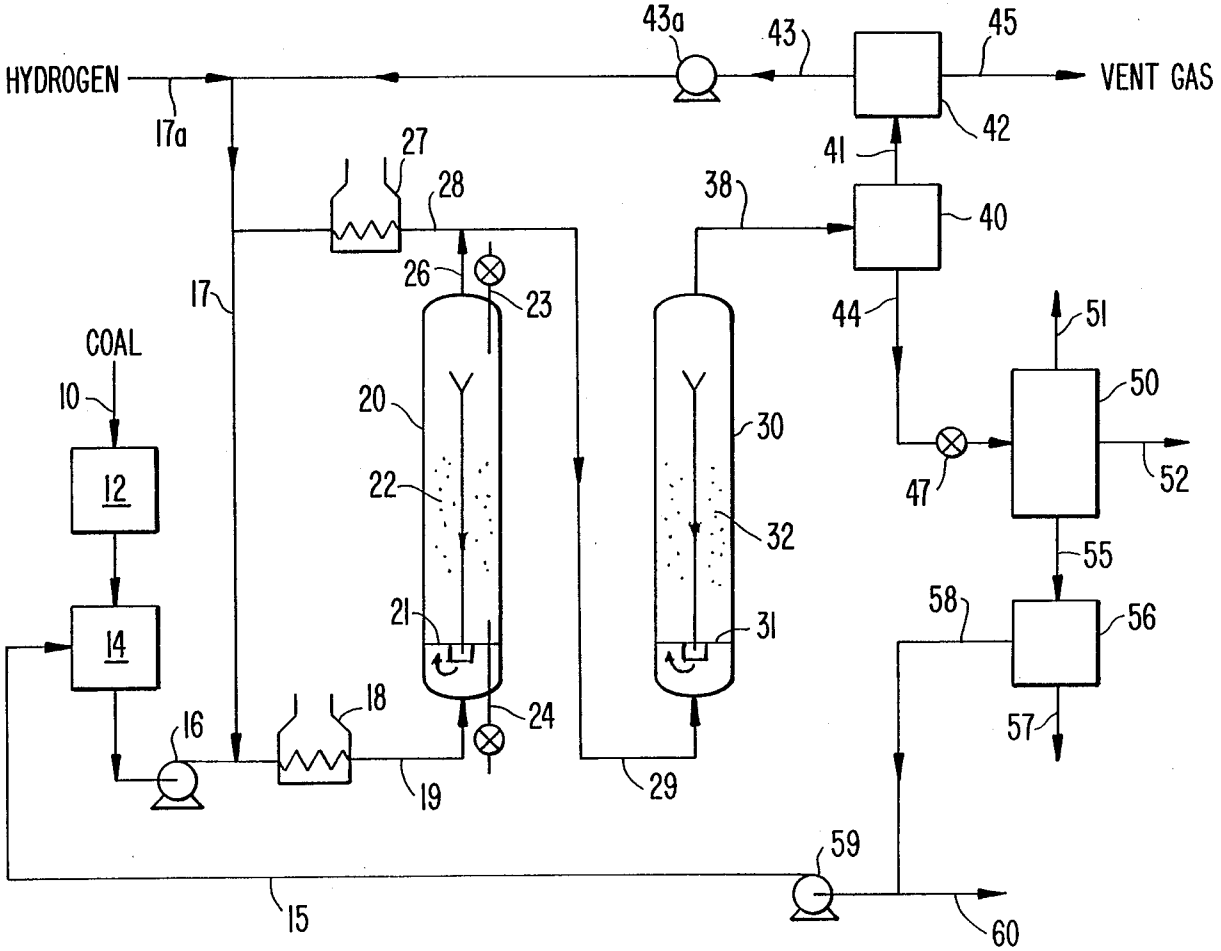
FIG. 1 is a schematic flow diagram of a two-stage catalytic coal hydrogenation and liquefaction process in accordance with the invention.

In the present invention, improved hydrogenation and liquefaction of coal is achieved by a two-stage catalytic process using two well-mixed ebullated bed catalytic reactors direct-connected in series. As is shown in FIG. 1, a coal such as bituminous, subbituminous or lignite is provided at 10 and passed through a coal preparation unit 12, where the coal is ground to a desired particle size range such as 50-375 mesh (U.S. Sieve Series) and dried to a desired moisture content such as 3-10 W % moisture. The particulate coal is then slurried at tank 14 with sufficient process-derived recycle solvent liquid 15 having a normal boiling temperature above about 550° F. to provide a flowable slurry. The weight ratio of solvent oil/coal is usually 1.4-5.0, with 1.5-3.0 being preferred. The coal/oil slurry is pressurized at pump 16, mixed with recycled hydrogen at 17, preheated at heater 18 to 600°-650° F. temperature and is then fed into the lower end of first stage back-mixed catalytic ebullated bed reactor 20. Fresh make-up high-purity hydrogen is provided as needed at 17*a*.

The coal-oil slurry and hydrogen streams enter reactor 20 containing an ebullated catalyst bed 22, passing uniformly upwardly through flow distributor 21 at flow rate and at temperature and pressure conditions to accomplish the desired hydrogenation reactions. The operation of the ebullated bed catalytic reactor including internal recycle of reactor liquid upwardly through the expanded catalyst bed is generally well known and is described by U.S. Pat. No. 4,437,973, which is incorporated herein by reference. The first stage reactor 20 preferably contains a particulate hydrogenation catalyst such as cobalt molybdate, nickle molybdate, or nickel tungsten on an alumina or silica support material. In addition, fresh particulate hydrogenation catalyst may be added to reactor 20 at connection 23 in the ratio of about 0.1 to 2.0 pounds of catalyst per ton of coal processed. Spend catalyst may be removed from reactor 20 at connection 24 to maintain the desired catalytic activity within the reactor.

Operating conditions in the first stage reactor are maintained at moderate temperature range of 650°-800° F., 1000-4000 psig hydrogen partial pressure, and coal feed rate or space velocity of 10-60 lb coal/hr/ft$^3$ reactor volume. The preferred reaction conditions will of 700°-790° F. temperature, 1500-3500 psig hydrogen partial pressure and 15-50 lb coal/hr/ft$^3$ reactor volume will be specific to the particular coal being processed, because different coals convert to liquids under thermal conditions at different rates. The optimal first stage reaction conditions will allow maxium utilization of hydrogen shuttling solvent compounds, such as pyrene/hydropyrenes, known to be present in coal-derived recycled oils, since catalytic rehydrogenation of donor species occurs simultaneously with solvent-to-coal hydrogen transfer. Coal-derived oils are also exposed to an efficient catalytic hydrogenation atmosphere immediately upon their formation, reducing the tendency for regressive repolymerization reactions which lead to poor quality hydrocarbon liquid products. First stage reactor thermal severity has been found to be quite important, as too high a severity leads to a coal conversion rate which is too rapid for the catalytic hydrogenation reactions to keep pace, as well as poorer hydrogenation equilibrium for the solvent compounds. Too low a thermal severity in the first stage, while still providing an efficient atmosphere for solvent hydrogenation, does not provide sufficient coal conversion to provide a substantial process improvement.

In the first stage reactor, the objective is to hydrogenate the aromatic rings in molecules of the feed coal, recycle solvent and dissolved coal so as to produce a high quality hydrogen donor solvent liquid in the presence of hydrogen and the hydrogenation catalyst. At the moderate catalytic reactor conditions used, heteroatoms are removed, retrogressive or coke forming reactions are essentially eliminated, and hydrocarbon gas formations are effectively minimized. Because of the reaction conditions used, i.e., relatively low temperature first stage, the catalyst promotes coal hydrogenation and minimizes polymerization and cracking reactions. Also because of these improved conditions in the first stage reactor, less coke is deposited on the catalyst at the milder reaction conditions used, and the deposited coke also has a desirably higher hydrogen/carbon ratio than for prior processes, which minimizes catalyst deactivation and appreciably prolongs the effective life of the catalyst.

From the first stage reactor 20, the total effluent material at 26 containing less than about 6 W % $C_1$–$C_3$ hydrocarbon gases, 15–25 W % 650° F.− light hydrocarbon liquid and 60–70 W % 650° F.+ heavy hydrocarbon materials, expressed on an MAF coal basis is mixed additional preheated hydrogen at 28 and flows directly to the lower end of close-coupled second stage catalytic reactor 30. The effluent material at 26 preferably contains 3–6 W % $C_1$–$C_3$ hydrocarbon gases, 18–22 W % $C_4$−650 ° F. light hydrocarbon liquid fraction, 12–16 W % 650°–850° F. hydrocarbon liquid, and the remainder 850° F.+ heavy hydrocarbon materials, all expressed on a MAF coal basis. This reactor 30 which operates similarly to reactor 20 contains flow distributor grid 31 and catalyst bed 32, and is operated at a temperature at least about 25° F. higher than for the first stage reactor, and usually in the temperature range of 750°–875° F., but at temperatures lower than conventionally used for single-stage catalytic coal liquefaction processes. The higher temperature used in reactor 30 may be accomplished by utilization of the preheated hydrogen stream 28 as well as the second stage reactor heat of reaction. The second stage reactor pressure is slightly lower than for the first stage reactor to permit forward flow of the coal slurry material without any need for pumping, and additional makeup hydrogen is added at 28 to the second stage reactor as needed. A particulate catalyst similar to that used in the first stage reactor is utilized in bed 32 for the second stage reactor.

In the second stage reactor 30, the reaction conditions are selected to provide a more complete catalytic conversion of the unconverted coal to liquids, utilizing the high quality solvent liquid produced in the first stage reactor. The remaining reactive coal as well as preasphaltenes and asphaltenes are converted to distillate liquid products along with additional heteroatoms removal. Substantial secondary conversion of coal derived liquids to distillate products, and product upgrading by heteroatoms removal, is also accomplished in the second stage reactor. The reaction conditions are selected to minimizes gas formation or dehydrogenation of the first stage liquid effluent materials. Useful reactor conditions are 750°–875° F. temperature, 1000–4000 psig hydrogen partial pressure, and coal space velocity of 10–60 lb coal/hr/ft$^3$ reactor volume. Preferred reaction conditions will depend on the particular type coal being processed, and are usually 800°–860° F. temperature, 1500–3500 pisg hydrogen partial pressure and 15–50 lb/hr/ft$^3$ reactor space velocity.

It is an important characteristic of this process that very little change in the hydrocarbon compounds composition occurs between the first and second stage reactions. It has been found that the 850° F.− distillate liquids contain much lower levels of condensed aromatics and are significantly more aliphatic than are products produced from a conventional single stage catalytic coal hydrogenation process. Recycle of residual oil greatly enhances hydrogenation and hydroconversion of the coal in the first stage reactor.

From the second stage reactor 30, the effluent material at 38 is passed to a phase separator 40 operating at near reactor conditions, wherein a vapor fraction 41 is separated from a solids-containing liquid slurry fraction at 44. The vapor fraction 41 is treated at hydrogen purification section 42, from which hydrogen stream 43 is withdrawn for recycle by compressor **43*a* to the reactors 20 and 30. Fresh make-up hydrogen is added as needed at 17*a*. A vent gas containing undesired nitrogen and sulfur compounds is removed as stream 45**.

The slurry liquid fraction 44 is pressure-reduced at 47 to near atmospheric pressure, such as about 200 psig, and passed to distillation system generally shown at 50. The resulting liquid fractions are recovered by a vapor/liquid flash in the distillation system 50, including atmospheric and vacuum distillation steps to produce light distillate product steam 51 and a heavier higher-boiling distillate liquid product stream 52. A bottoms stream 55 is passed to a liquid-solids separation step 56, from which unconverted coal and ash solids are removed at 57. The liquid stream 58 having reduced concentration of solids is recycled by pump 59 as slurring oil 15. If desired, a reduced solids concentration product liquid stream can be withdrawn at 60.

The recycle slurrying oil stream 58 is prepared by blending a portion of the atmospheric separator bottoms liquid slurry (containing 500° F.+ distillate, residuum, unreacted coal and ash), the atmospheric fractionation bottoms material (600° F. + distillate), and vacuum gas oil. This slurring liquid at 58 is then recycled back as stream 15 to the mixing step at 14, where it is mixed with the coal feed to form the flowable coal-oil slurry feedstream to the first stage reactor 20.

The recycle oil preparation in liquid-solids separation step 56 can be improved by reducing its solids concentration (ash and unconverted coal) by using known solids removal means in separation step 56, which such as by use of hydroclones, centrifuges, filters or solvent deashing techniques, with use of liquid hydroclones usually being preferred.

This invention will be further described and better understood by reference to the following Examples of comparative operations, which Examples whould not be construed as limiting the scope of the invention.

EXAMPLE 1

Several runs were made using the present two-stage catalytic process on Illinois No. 6 coal at the reaction conditions shown in Table 1, i.e., 750° F. first stage temperature and 825° F. second stage reactor temperature. From the results provided in Table 1, it is seen that substantially improved results including increased hydrogen effeiciencey and improved distillate liquid yields were achieved, as compared to results for a single stage catalytic coal liquefaction process operating at substantially the second stage reaction conditions. It should be noted that the yields of $C_4$–975° F. and 390°–975° F. materials are both significantly greater for the present two-stage process than for single stage processes.

From the improved results achieved by the present process, it was also unexpectedly found that the 850° F. minus distillate fraction contained much lower levels of condensed aromatics and are significantly more aliphatic than the similar boiling fractions from a single stage catalytic coal liquefaction process, as is shown in Table 2, showing the proton distribution of the 850° F. minus distillate liquid.

TABLE 2

PROTON DISTRIBUTION OF 850° F.-DISTILLATES

| | Single Stage H-Coal ® Process | Two-Stage Catalytic Process First Stage | Two-Stage Catalytic Process Second Stage |
|---|---|---|---|
| Aromatics | | | |
| Condensed | 24.8 | 7.4 | 8.1 |
| Uncondensed | 7.0 | 7.2 | 7.6 |
| Totals | 31.8 | 14.6 | 15.7 |
| Alpha Aliphatics | | | |
| Alkyl | 11.8 | 10.8 | 10.1 |
| Cyclic | 18.2 | 15.5 | 14.3 |
| Beta Aliphatics | | | |
| Alkyl | 16.6 | 24.4 | 25.0 |
| Cyclic | 13.5 | 21.1 | 20.1 |
| Gamma Aliphatics | 8.0 | 13.6 | 14.8 |
| Totals | 68.1 | 85.4 | 84.3 |

TABLE 1

CATALYTIC TWO-STAGE PROCESS PERFORMANCE

Feed: Illinois No. 6 Coal - 70 U.S. Mesh size
Catalyst: First Stage - Amocat 1C
Second Stage - Amocat 1A

| | | | |
|---|---|---|---|
| Average Catalyst Age, Lb Dry Coal/Lb Catalyst | 216.3 | 664.3 | Single Stage Catalytic(2) |
| OPERATING CONDITIONS | | | |
| Temperature, °F. | | | |
| First Stage | 750 | 750 | |
| Second Stage | 825 | 825 | 850 |
| Pressure, psig | 2506 | 2515 | 2500 |
| Dry Coal Space Velocity (ea. stage), Lb Dry Coal/Hr/Ft$^3$ | 68 | 68 | 68 |

TABLE 1-continued

CATALYTIC TWO-STAGE PROCESS PERFORMANCE

| | | | |
|---|---|---|---|
| Catalyst(3) | | | |
| Total Material Recovery, (Gross) W % | 97.6 | 97.31 | |
| NORMALIZED YIELD, W % Dry Coal | | | |
| $C_1$–$C_3$ Gas | 5.6 | 5.9 | 12.1 |
| $C_4$–390° F. Liquid | 17.9 | 16.2 | 21.2 |
| 390–500° F. Liquid | 13.9 | 12.2 | |
| 500–650° F. Liquid | 16.8 | 16.8 | |
| 650–850° F. Liquid | 11.7 | 10.9 | |
| 850–975° F. Liquid | 4.0 | 3.7 | |
| 390–975° F. Liquid | 46.4 | 49.4 | 32.0 |
| $C_4$–975° F. Liquid | 64.3 | 65.6 | 53.2 |
| 975° F. + Material | 4.9 | 4.6 | |
| Unconverted Coal | | | |
| Ash | 11 | 11.1 | |
| $H_2O$ | 9.2 | 9.0 | |
| $CO + CO_2$ | 0.46 | 0.3 | |
| $NH_3$ | 1.25 | 1.1 | |
| $H_2S$ | 2.6 | 2.7 | |
| Total (100 + $H_2$ Reacted) | 106.1 | 105.56 | |
| PROCESS PERFORMANCE | | | |
| Coal Conversion W % M.A.F. | 94.3 | 94.8 | 94.6 |
| 975° F. + Conversion, W % M.A.F. | 86.9 | 82.2 | 72.0 |
| Hydrogen Efficiency | 10.5 | 10.7 | 9.6 |
| $C_4$–975° F., W % M.A.F. | 72.3 | 67.2 | |
| Organic Sulfur Removal, W % | 98.0 | 96.6 | |
| Nitrogen Removal, W % | 79.2 | 66.5 | |
| $C_4$–975° F. DISTILLATE QUALITY | | | |
| Gravity, °API | 25.5 | 23.7 | |
| Sulfur, W % | 0.035 | 0.037 | |
| Nitrogen, W % | 0.19 | 0.33 | |

(3) Space velocity expressed in terms of catalyst bed settled volume, which is equivalent to about twice the space velocity expressed in terms of reactor total volume;

This indicates that relatively little change occurs in chemical structure of the compounds in the second stage reactor compared to those in the first stage, and that significantly more aliphatic type compounds are produced in the two-stage catalytic process.

EXAMPLE 2

Additional runs were made for this two-stage catalytic process on sub-bituminous Wyodak coal. Comparative results with the Illinois No. 6 bituminous coal runs of example 1 are shown in Table 3.

TABLE 3

COMPARATIVE PROCESS PERFORMANCE

| | ILLINOIS NO. 6 TWO STAGE | WYODAK(1) TWO STAGE | WYODAK(2) H-COAL ® SINGLE STAGE |
|---|---|---|---|
| $C_1$–$C_3$ Gas W % M.A.F. Coal | 5–7 | 7–10 | 5–13 |
| $C_4$–975° F., W % M.A.F. Coal | 63–68 | 54–68 | 47–51 |
| Coal Conversion, W % M.A.F. Coal | 94–95 | 79–92 | 82–91 |
| Hydrogen Consumption | 6–7 | 6–8 | 5–7 |
| Hydrogen Efficiency | 10–11 | 8–9 | 7–10 |
| 975° F.+ Conversion | 81–87 | 74–90 | 69–78 |

(1)Preliminary Data
(2)Run 227-4 and 177-87, H-Coal ® Single Stage Catalytic Process It is noted that percent coal conversion and yield of $C_4$–975° F. material is somewhat less for Wyodak coal than for the Illinois No. 6 coal.

Results for the present two-stage catalytic process compared with the H-coal® single stage catalytic process on Wyodak coal are also shown in Table 3. It is noted that although the percent conversion of the Wyodak subbituminous coal is comparable to that for the single stage process, the $C_4$–975° F. yield and the conversion of the 975° F.+ material are significantly higher than for the single stage process.

EXAMPLE 3

During two-stage catalytic operations on Wyodak coal, the effect of first stage reactor temperature on hydrogen content of reactor liquids and the solvent quality and on $C_4$–975° F. yields were investigated. The first stage reactor temperature was varied between 650° F. and 775° F. with the second stage reactor temperature maintained at 810° F. and at 45 lb/hr-ft$^3$ catalyst space velocity in each reactor. The results for hydrogen content of the reactor liquid as indicated by hydrogen/carbon ratios are shown in Table 4.

TABLE 4

HYDROGEN CONTENT OF REACTOR LIQUIDS - RUN 227-22

| FIRST STAGE REACTOR TEMP. °F. | HYDROGEN TO CARBON RATIO | | | |
|---|---|---|---|---|
| | 650–850° F. LIQUIDS | | 850° F.+ LIQUIDS | |
| | FIRST STAGE | SECOND STAGE | FIRST STAGE | SECOND STAGE |
| 650 | 1.35 | 1.32 | 1.09 | 0.99 |
| 700 | 1.36 | 1.35 | 1.11 | 1.07 |
| 750 | 1.34 | 1.30 | 1.04 | 0.98 |
| 775 | 1.29 | 1.29 | 0.97 | 0.94 |

From these data, it is seen that the hydrogen to carbon ratios are greater for the first than for the second stage reactors at temperature up to about 750° and decline at 775° F. first stage temperature. Also, it is pointed out that these hydrogen/carbon ratios are among the highest reported in the literature for processing Wyodak coal.

The effect of first stage reactor temperature on solvent quality as determined by coal conversion achieved under standard autoclave test conditions is shown in Table 5.

TABLE 5

SOLVENT QUALITY OF REACTOR PRODUCTS - RUN 227-22

| FIRST STAGE TEMP.°F. | COAL CONVERSION, W % M.A.F. COAL(2) | |
|---|---|---|
| | FIRST STAGE | SECOND STAGE |
| 650 | 64.5 | 60.0 |
| 700 | 70.4 | 60.8 |
| 750 | 64.1 | 47.9 |
| 750 | 64.6 | 49.7 |
| 750(1) | 51.6 | 54.2 |
| 775 | 42.6 | 46.7 |

TABLE 5-continued

SOLVENT QUALITY OF REACTOR PRODUCTS - RUN 227-22

| FIRST STAGE TEMP.°F. | COAL CONVERSION, W % M.A.F. COAL(2) | |
|---|---|---|
| | FIRST STAGE | SECOND STAGE |

(1) Wet coal feed producing lower hydrogen partial pressure
(2) HRI Solvent Quality Test Conditions:

| | |
|---|---|
| Coal | Upper Wyodak |
| Temperature | 750° F. |
| Residence Time | 30 Minutes |
| Type Test | Thermal |
| Solvent | Stage 1 - Filtered Liquid Product<br>Stage 2 - Filtered Atmospheric Still Bottoms |
| Conversion | As measured by solubility of microautoclave product in THF |

It is noted that the solvent quality is higher in the first stage reactor up to a first stage reactor temperature of about 750° F.

Figure 2:
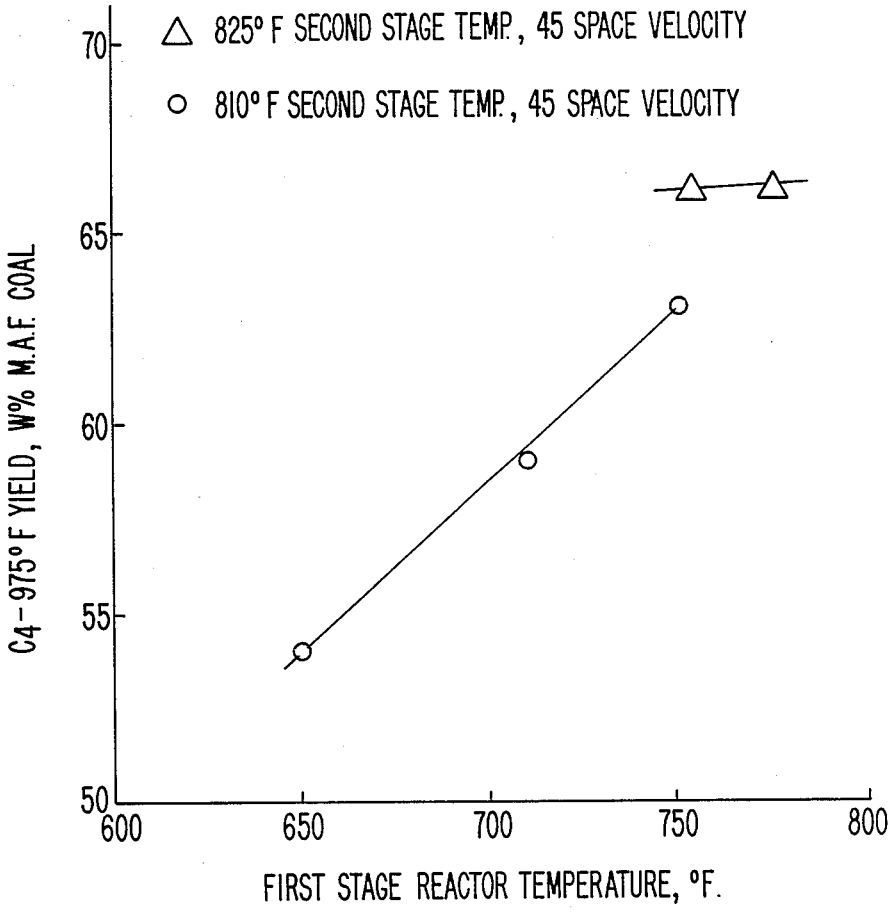
FIG. 2 is a graph showing the effect of first stage reactor temperatures on the yield of $C_4$—975° F. hydrocarbon product liquid.

The effect of first stage reactor temperature on $C_4$–975° F. liquid yields is shown in FIG. 2. It is seen that improved $C_4$–975° F. yields are obtained for increasing first stage reaction temperature from 650° F. up to about 750° F., and that liquid yields are further increased as the second stage reactor temperature is increased from 810° F. to 825° F. Thus, the improved solvent liquid quality achieved in the first and second stage reactors is indicated by the high hydrogen content of the 650°–850° F. and 850° F.+ reactor liquid fractions as shown in Table 14 and the coal conversions obtained based on the standard test for solvent quality as shown in Table 5.

EXAMPLE 4

The present two-stage catalytic coal liquefaction process is compared with other two-stage thermal-catalytic coal liquefaction processes, as shown in Table 6.

TABLE 6

COMPARISON WITH THERMAL - CATALYTIC PROCESSES

| Coal | TWO-STAGE CATALYTIC | HRI THERMAL-CATALYTIC | KERR-MCGEE THERMAL CATALYTIC |
|---|---|---|---|
| | ←Wyodak Clovis Point→ | | |
| $C_1$–$C_3$ gas, W % | 8.1 | 9.9 | 12.8 |
| $C_4$–850° F. Liquid, W % | 65.5 | 52.9 | 52.6 |
| Coal Conversion, W % MAF Coal | 89.3 | 90.2 | 92.1 |
| Hydrogen Consumption | 8.1 | 6.6 | 5.2 |
| Hydrogen Efficiency | 8.1 | 8.5 | 10.1 |
| 975° F.+ Conversion | 87.4 | 76.9 | 78.6 |

From this comparison, it is seen that the present catalytic two-stage process provides improved results of reduced $C_1$–$C_3$ gas yields, increased $C_4$–850° F. liquid yields, and increased conversion of 975° F. + fraction material compared to the other processes.

Although this invention has been described broadly and in terms of certain preferred embodiments thereof, it will be understood that modifications and variation of the process can be made within the spirit and scope of the invention, which is defined by the following claims.

We claim:

1. A process for two-stage catalytic hydrogenation of coal to produce low-boiling hydrocarbon liquid and gaseous products, consisting essentially of:

(a) mixing particulate coal and a process-derived recycled hydrocarbon slurrying liquid in a coal slurrying step to provide a flowable slurry, and feeding said slurry at a temperature below about 650° F. into a pressurized first stage back-mixed catalytic reaction zone containing coal-derived liquid and hydrogen and an ebullated bed of particulate hydrogenation catalyst, said particulate catalyst having effective diameter of 0.030–0.125 inch;

(b) passing said coal and hydrogen gas upwardly through said first stage back-mixed ebullated bed of particulate hydrogenation catalyst, said catalyst containing an active metal component wherein the metal in said component is selected from the group consisting of cobalt, iron, molybdenum, nickel, tin, tungsten and mixtures thereof deposited on a support material, said catalyst bed being maintained at 650°–800° F. temperature and 1000–4000 psig hydrogen partial pressure and space velocity of 10–60 lb coal/hr $ft^3$ reactor volume to rapidly heat the coal and catalytically hydrogenate it and recycled solvent with minimal retrogressive dehydrogenation reactions to produce a partially hydrogenated and hydroconverted coal-derived effluent material containing less than about 6 W % $C_1$–$C_3$ hydrocarbon gases, 15–25 W % 650° F. light liquid fraction and 60–70 W % 650° F.+ hydrocarbon material fraction;

(c) a withdrawing said partially hydrogenated coal-derived material containing gas and liquid fractions from said first stage reaction zone, and passing said material together with additional hydrogen gas directly to a close-coupled second stage back-mixed catalytic reaction zone, said second stage reaction zone containing a bed of particulate catalyst, said catalyst having an effective diameter of 0.030 –0.125 inch and containing an active metal component wherein the metal in said component is selected from the group consisting of cobalt, iron, molybdenum, nickel, tin, tungsten and mixtures thereof deposited on a support material, said second stage reaction zone being maintained at a temperature at least about 25° F. higher than the temperature for the first stage reaction zone and within a range of 750°–875° F.temperature and 1000–4000 psig hydrogen partial pressure and space velocity of 10–60 lb coal/hr $ft_3$ reaction volume for further reacting and hydrocracking the liquid fraction material therein with minimal dehydrogenation reactions to produce an effluent material containing hydrocarbon gase and lower boiling hydrocarbon liquids containing a 650° F.+ fraction; wherein the 650° F.+ fraction for said first stage reaction zone effluent has a hydrogen/carbon ratio greater than said 650° F.+ fraction for said second stage reaction zone effluent;

(d) withdrawing from said second stage catalytic reaction zone the hydrocracked effluent material containing said hydrocarbon gases and liquid fractions, and phase separating said material into separate gas and liquid fractions;

(e) passing said liquid fraction to a distillation step and a liquid-solids separation step, from which a liquid stream normally boiling above about 550° F. and containing a reduced concentration of particulate solids is recycled as said hydrocarbon slurrying liquid directly to the coal slurrying step; and (f) recovering hydrocarbon gas and high yields of low boiling hydrocarbon distillate liquid products normally boiling between 150°–975° F. from the process, wherein at least 90 W % conversion of the coal feed to lower boiling hydrocarbon liquid and gaseous materials is achieved.

2. The process of claim 1, wherein the first stage reaction zone is maintained at 700°–790° F. temperature, 1500–3500 psig hydrogen partial pressure, and 15–50 lb/hr/$ft^3$ reactor space velocity.

3. The process of claim 1, wherein the second stage reaction zone is maintained at 800°–860° F. temperature and 1500–3500 psig hydrogen partial pressure.

4. The process of claim 1, wherein the first stage reaction zone contains a particulate hydrogenation catalyst comprising nickel and molybdenum on an alumina support material.

5. The process of claim 1, wherein the second stage reaction zone contains a catalyst comprising cobalt and molybdenum on an alumina support material.

6. The process of claim 1, wherein the effluent material for the first and second stage reaction zones includes 650°–850° F. and 850° F.+ fractions, which fractions for the first stage reaction zone have a hydrogen-to-carbon ratio greater than that for the fractions for effluent from the second stage reaction zone.

7. The process of claim 1, wherein the coal feed is bituminous type coal.

8. The process of claim 1, wherein the coal feed is sub-bituminous type coal.

9. The process of claim 1, wherein said effluent material from the first stage reaction zone includes 3–6 W % $C_2$–$C_3$ hydrocarbon gases, 18–22 W % $C_4$–650° F. light hydrocarbon liquid fraction, 12–16 W % 650°–850° F. liquid fraction, and the remainder 850° F.+ heavy hydrocarbon materials all expressed on MAF coal basis.

10. The process of claim 1, wherein the yield of $C_4$–975° F. hydrocarbon liquid fraction is improved for increased first stage reactor temperature between 650° F. and 750° F.

11. A process for two-stage catalytic hydrogenation of coal to produce low-boiling hydrocarbon liquid and gaseous products, consisting essentially of:

(a) mixing particulate bituminous coal with process-derived recycled hydrocarbon liquid in a coal slurrying step to provide a flowable slurry and feeding the coal-oil slurry at temperature below about 650° F. directly into a pressurized first stage back-mixed catalytic reaction zone containing coal-derived liquid and hydrogen and an ebullated bed of particulate hydrogenation catalyst, said particulate catalyst having effective diameter of 0.030–0.125 inch;

(b) passing the coal slurry and hydrogen gas upwardly through said first stage back-mixed ebullated bed of particulate hydrogenation catalyst, said particulate catalyst containing an active metal component wherein the metal in said component is selected from the group consisting of cobalt, iron, molybdenum, nickel, tin, tungsten and mixtures thereof deposited on a support material selected from the group consisting of alumina, magnesia, silica and combinations thereof, said bed being maintained at 700°–790° F. temperature, 1500–3500 psig hydrogen partial pressure, and space velocity of 15–50 lb coal/hr $ft^3$ reactor volume to rapidly heat the coal and catalytically hydrogenate it and recycled solvent with minimal retrogressive dehydrogenation reactions to produce a partially hydrogenated and hydroconverted coal-derived effluent material containing less than about 6 W % $C_1$–$C_3$ hydrocarbon gases, 20–25 W % 650° F.– light liquid fraction, 12–16 W % 650°–850° F. liquid fraction and the remainder 850° F.+ heavy hydrocarbon material fraction;

(c) withdrawing said partially hydrogenated coal-derived material containing gas and liquid fractions from said first stage reaction zone and passing said material together with additional hydrogen gas to a close-coupled second stage back-mixed catalytic reaction zone, said second stage reaction zone containing a bed of particulate catalyst, said particulate catalyst having an effective diameter of 0.030–0.125 inch and containing an active metal component wherein the metal in said component is selected from the group consisting of cobalt, iron, molybdenum, nickel, tin and mixtures thereof deposited on a support material of alumina, magnesia, silica, and mixtures thereof, said second stage reaction zone being maintained at a temperature at least about 25° F. higher than for the first stage reaction zone and within a range of 800°–860° F. temperature, 1500–3500 psig hydrogen partial pressure and 15–50 lb coal/hr $ft^3$ reactor volume for further reacting and hydrocracking the liquid fraction therein with minimal dehydrogenation reactions to produce an effluent material containing gas and low boiling hydrocarbon liquids containing a 650°–850° F. fraction and a 850° F.+ fraction, wherein the 650°–850° F. and 850° F.+ fractions for said first stage reaction zone effluent has a hydrogen/carbon ratio greater than said fractions for said second stage reaction zone;

(d) withdrawing from said second stage catalytic reaction zone the hydrocracked effluent material containing gas and liquid fractions, and phase separating said material into separate gas and liquid fractions;

(e) passing said liquid fraction to distillation steps and a liquid-solids separation step, from which a liquid stream normally boiling above about 550° F. and containing a reduced concentration of particulate solids is recycled as said hydrocarbon slurrying liquid directly to the coal slurrying step; and (f) recovering hydrocarbon gas and high yields of hydrocarbon liquid products normally boiling between 400°975° F. from the process, wherein at least 90 W % conversion of the coal feed to lower-boiling hydrocarbon liquid and gaseous materials is achieved.

* * * * *

UNITED STATES PATENT AND TRADEMARK OFFICE

CERTIFICATE OF CORRECTION

PATENT NO. : 4,842,719

DATED : June 27, 1989

INVENTOR(S) : James B. MacArthur, Joseph B. McLean, Alfred G. Comolli

It is certified that error appears in the above-identified patent and that said Letters Patent is hereby corrected as shown below:

Column 1, line 23, "Catalyst gas yields and" should read "gas yields and catalyst"

Column 1, line 34, delete "as"

Column 1, line 37, "present" should be --presence--

Column 2, line 43, "lb/coal hr" should read "lb coal/hr"

Column 2, line 46, "coal tetrahydrofuran to" should read "coal to tetrahydrofuran"

Column 2, line 61, after "zone" insert --where-

Column 3, line 6, delete "coal space velocity of"

Column 3, line 8, after "and" insert --coal space velocity of--

Column 3, line 11, after "compounds" insert --to lower boiling hydrocarbon materials--

UNITED STATES PATENT AND TRADEMARK OFFICE

CERTIFICATE OF CORRECTION

PATENT NO. : 4,842,719

DATED : June 27, 1989

INVENTOR(S) : James B. MacArthur, Joseph B. McLean, Alfred G. Comolli

It is certified that error appears in the above-identified patent and that said Letters Patent is hereby corrected as shown below:

Column 5, line 35, after "mixed" insert --with--

Column 9, line 14, before "yields" insert --liquid--

Column 10, line 31, change "14" to --4--

Column 11, line 26, delete "a"

Column 11, line 48, "gase" should read "gases"

Signed and Sealed this

Twenty-sixth Day of June, 1990

*Attest:*

HARRY F. MANBECK, JR.

*Attesting Officer*

*Commissioner of Patents and Trademarks*